US009603503B2

(12) United States Patent
Chilcoat et al.

(10) Patent No.: US 9,603,503 B2
(45) Date of Patent: Mar. 28, 2017

(54) LIQUID LEAK CONTROL APPLIANCE PEDESTAL

(76) Inventors: Edward A. Chilcoat, Columbus, OH (US); Daniel J. Hayes, Edgewater, MD (US)

( * ) Notice: Subject to any disclaimer, the term of this patent is extended or adjusted under 35 U.S.C. 154(b) by 1017 days.

(21) Appl. No.: 12/800,595

(22) Filed: May 18, 2010

(65) Prior Publication Data

US 2011/0284094 A1 Nov. 24, 2011

(51) Int. Cl.

| | |
|---|---|
| ***A47L 15/42*** | (2006.01) |
| ***D06F 39/08*** | (2006.01) |
| ***D06F 39/12*** | (2006.01) |
| ***F17D 1/14*** | (2006.01) |
| ***F17D 5/02*** | (2006.01) |

(52) U.S. Cl.

CPC ..... *A47L 15/4212* (2013.01); *A47L 15/4223* (2013.01); *D06F 39/081* (2013.01); *D06F 39/085* (2013.01); *D06F 39/125* (2013.01); *F17D 1/14* (2013.01); *F17D 5/02* (2013.01); *Y10T 29/49826* (2015.01); *Y10T 137/0402* (2015.04); *Y10T 137/5835* (2015.04); *Y10T 137/8158* (2015.04); *Y10T 137/86043* (2015.04); *Y10T 137/86067* (2015.04)

(58) Field of Classification Search

USPC ..... 137/312; 34/58

See application file for complete search history.

(56) References Cited

U.S. PATENT DOCUMENTS

| | | | | | |
|---|---|---|---|---|---|
| 1,594,248 | A | * | 7/1926 | Efstathiou | 62/400 |
| 3,096,781 | A | * | 7/1963 | Roidt | 137/314 |
| 3,186,427 | A | * | 6/1965 | Martin et al. | 137/343 |
| 3,261,177 | A | | 7/1966 | Amann et al. | |
| 3,276,222 | A | | 10/1966 | Hutchinson | |
| 3,304,950 | A | | 2/1967 | Hubert | |
| 3,353,615 | A | * | 11/1967 | Nekimken | 177/245 |
| 3,353,621 | A | * | 11/1967 | Clevett, Jr. | 180/124 |
| 3,359,645 | A | | 12/1967 | Whistler, Jr. | |
| 3,400,780 | A | | 9/1968 | Kesling | |
| 4,706,718 | A | * | 11/1987 | Milo | 141/86 |
| 4,903,723 | A | * | 2/1990 | Sublett | 137/312 |
| D337,154 | S | | 7/1993 | Simpson | |
| 5,437,303 | A | | 8/1995 | Johnson | |
| 5,452,739 | A | | 9/1995 | Mustee et al. | |
| 6,116,266 | A | * | 9/2000 | Dickison et al. | 137/312 |
| 6,273,021 | B1 | * | 8/2001 | Pembroke | 116/228 |
| 6,276,309 | B1 | * | 8/2001 | Zeek | 122/504 |
| 7,421,784 | B2 | * | 9/2008 | Akkala et al. | 29/890.03 |
| 2009/0095331 | A1 | * | 4/2009 | Hoppe | 134/99.2 |
| 2009/0261108 | A1 | | 10/2009 | Steinberg | |

* cited by examiner

*Primary Examiner* — Mary McManmon
*Assistant Examiner* — Daphne M Barry
(74) *Attorney, Agent, or Firm* — Frank H. Foster; Kremblas & Foster

(57) ABSTRACT

Appliance pedestal that contains liquid leaks due to condensation, overflow, or system failure originating from the supported liquid filled or handling appliance, provides for multiple methods of discharge of collected liquids, and reduces installation and maintenance requirements and their associated hazards and provides an improved ergonomic operating position for the appliance operator.

2 Claims, 11 Drawing Sheets

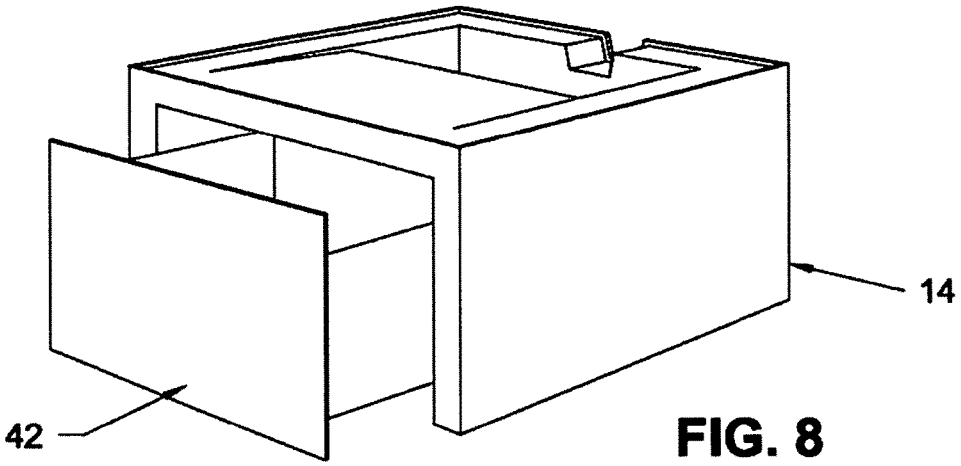
FIG. 8
FIG. 9
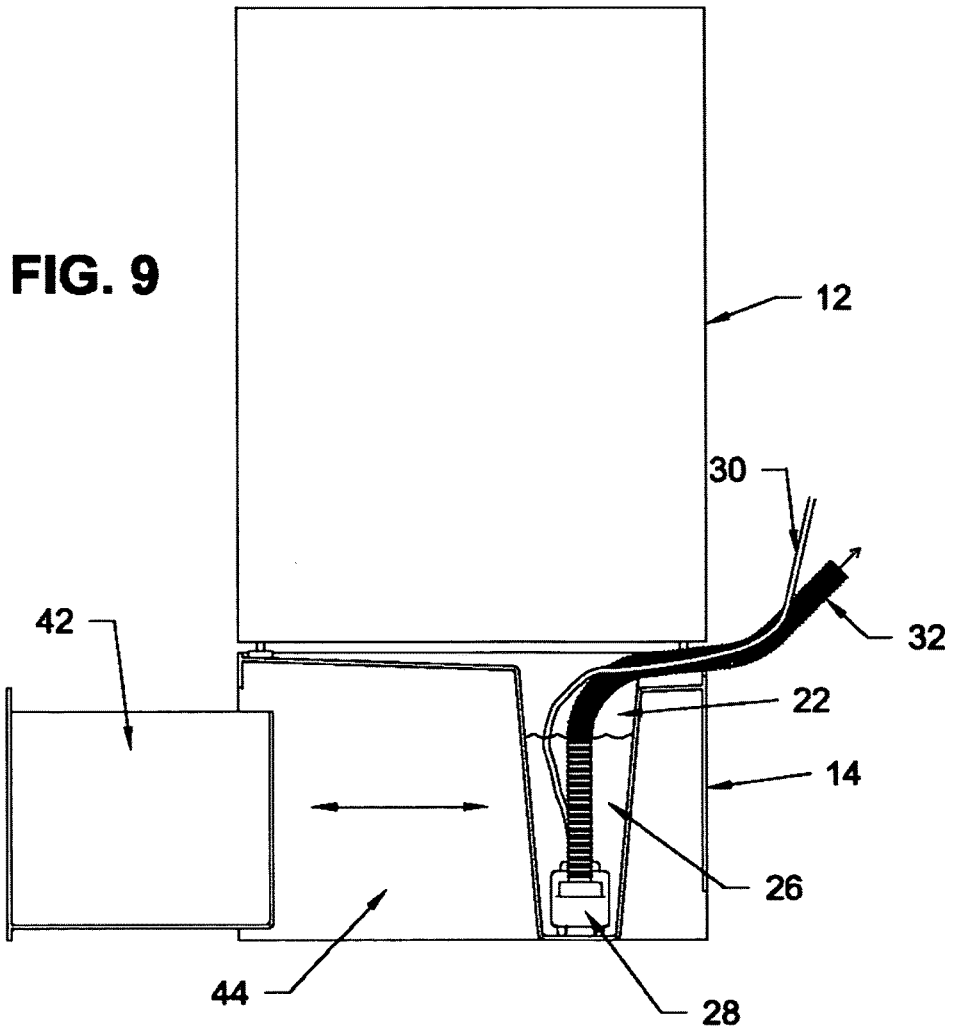

FIG. 12
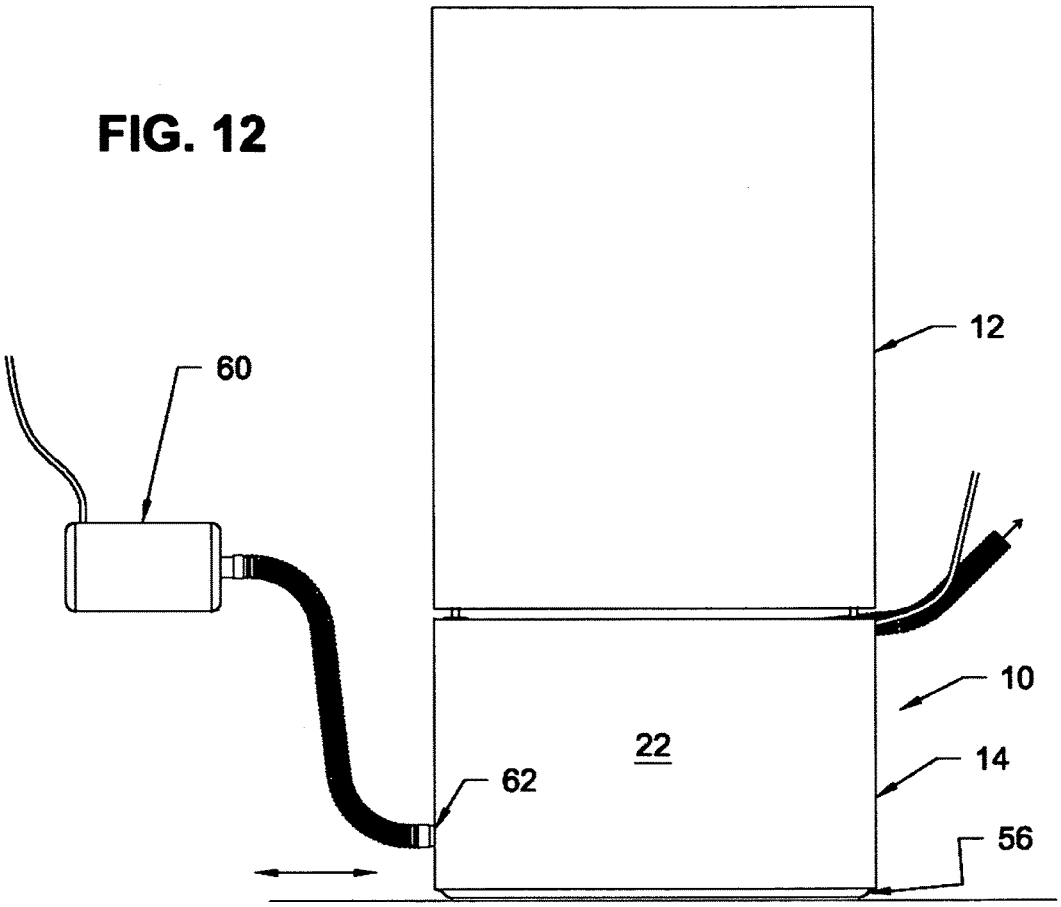
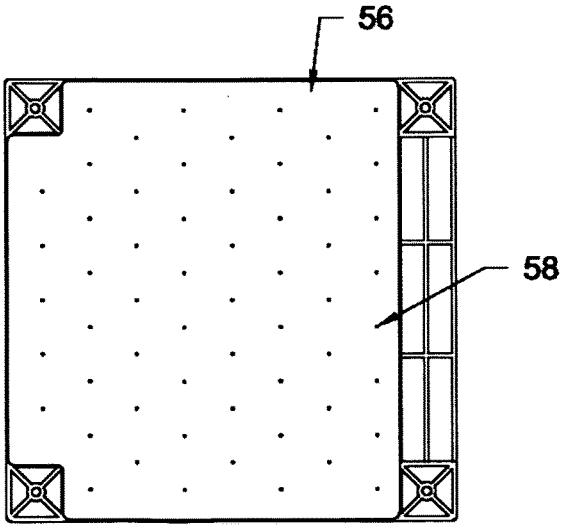
FIG. 13

Step 1 - Tip rear appliance feet on to the support rails at the front on the pedestal Step 2 - Tip the appliance to the rear Step 3 - Slide the appliance on the support rails to the rear of the pedestal Step 4 - Tip the appliance forward to a level position on the pedestal

LIQUID LEAK CONTROL APPLIANCE PEDESTAL

BACKGROUND OF THE INVENTION

Field of the Invention

The present invention relates to the field of appliance elevating and storage pedestals and the containment and proper discharge of liquids due to plumbing failure, seal failure, or mechanical failure within a liquid filled appliance such as but not limited to clothes washing machines, condensing clothes dryers, water heaters, dishwashers, refrigerators, icemakers, and similar devices.

Background of the Invention

Damage to building structures and property can result from liquid leakage due to failures within a liquid filled, liquid handling, or liquid generating appliances. The damage can be quite significant especially in multi-family and multi-level structures. This risk of significant damage has also spurred the creation of building codes that require the installation of some system of control to prevent such damage in the event of liquid control failure within a piece of equipment.

The currently accepted method to catch and control leaks is the use of a shallow drip or catch pan that is placed between the appliance and the supporting surface immediately under the appliance. Installations have either no drain or they are plumbed to a drain and flow is accomplished by gravity. This method of control typically has five inherent primary shortcomings.

- Machines must be lifted in or out of pan for installation and service.
- The shallow pans have limited retention capacity.
- When a pan of this configuration is deepened to increase water retention capacity, the machine sits in the reservoir and can be damaged do to corrosion and electrically energized components are exposed to liquids creating potentially dangerous conditions.
- The limited reservoir does not support a method for pumping liquids to an elevated drain or standpipe.
- It does not address raising the appliance for improved ergonomic benefits.

This style of pan typically requires the installer or service personnel to lift the appliance vertically in or out of the pan during installation or service of the equipment frequently resulting in damage to the pan or strain and injury to the service personnel or both. Many times it requires two installers or repair personnel to lift the machine in or out of such a pan resulting in higher installation and repair costs. Equipment installations in confined closet type installations are extremely difficult because personal must lift the appliance from multiple sides were there is limited or no access. Installers or repair personnel must lift the entire weight of the appliance plus content mass if the appliance cannot be unloaded or drained.

The shallow cross section of the present ail provides only a minimum liquid retention volume. Increasing height of the perimeter wall can increase the liquid retention volume but exacerbate the aforementioned installation and maintenance issues. Allowing these increased liquid levels can also increase direct damage to the appliance itself and create safety hazards such as liquid levels coming into contact with energized parts or submerging fuel gas supply systems.

Collection pan systems disclosed in the present art do not accommodate a necessary sump or volume area for the incorporation of a pump system to positively discharge liquids collected by the invention to existing plumbing systems regardless of distance or elevation.

With the growing trend of front load washing equipment, a new market has developed for pedestals that raise the level of the machine to a more ergonomically acceptable height. Some of these pedestal designs incorporate additional storage area, usually in the form of a drawer. Raising the height of the machine reduces the stooping and bending necessary to load and unload the machine by the operator. Adjusting the height of such equipment is also a need to meet height requirements set forth by the ADA or Americans with Disabilities Act. The current art in elevating pedestals, such as those used to elevate laundry appliances, provide no means of leak control. The current art in leak control, the drip or catch pan, does not add any measurable height to the appliance installed within it.

The purpose of the present invention is to effectively contain liquid leaks originating from appliances and support devices supported by the invention, provide multiple methods of retention and disposal of the captured liquids, provide for improved ease of installation and maintenance of said equipment, while providing an ergonomic improvement by raising the height of such installations.

BRIEF SUMMARY OF THE INVENTION

This invention incorporates the functions of liquid leak control collection and disposal into an appliance elevating pedestal into a single device. It provides liquid control in both passive and active manners. For passive control, the invention directs leaking liquids to the incorporated retention sump out of contact with the appliance. The collected liquid may be retained or discharged by means of an incorporated gravity drain. The invention provides active control by supplying space for the incorporation of a pump for discharging collected liquids to an elevated or distant plumbing system such as a standpipe. The invention eliminates the need for lifting the full weight of the appliance. The invention does not need to be mounted to the appliance eliminating much of the handling requirements for the installation of a pedestal. It facilitates installation and maintenance of the supported appliance from the front of the invention by one person. It provides for mounting to the supporting surface to prevent "creeping" of the appliance by inertia generated by earthquake or "out of balance" conditions during an appliance operating cycle. The invention elevates the supported appliance for improved ergonomic use of the appliance by an operator and compliance with ADA.

This invention incorporates functions of liquid leak control into an elevating pedestal. It supports control in both a passive control and active control manner. For passive control, the invention channels leaking liquids directly to a high capacity sump. The sump provides an improved location for a water sensing device, used by an alarm or liquid shut off system, instead of the typical floor location under the washing machine. This assures that leaking water will be directed towards the sensor regardless of the location of the leak within the machine. This is important due to the fact that slope and location can affect the ability of a sensor used in passive systems to come in contact with the leaking water. For an active water control system, the invention channels water to an incorporated sump. This provides containment of the water leaked and provides an appropriate location for an active pump system that will discharge the water to a nearby drain or standpipe.

Other features of the present appliance pedestal and system will become more apparent in light of the following detailed description of a preferred embodiment thereof and as illustrated in the accompanying drawings.

BRIEF DESCRIPTION OF THE DRAWINGS

FIG. 8 is a perspective view of the appliance pedestal having a drawer provided therein;

FIG. 9 is a side view, cut away, illustrating the embodiment of FIG. 8;

FIG. 12 is a side view of an integral air cushion transport system used with the present appliance pedestal;

FIG. 13 is a bottom view of the air cushion transport system of FIG. 12.

DETAILED DESCRIPTION OF THE INVENTION

Figure 1:
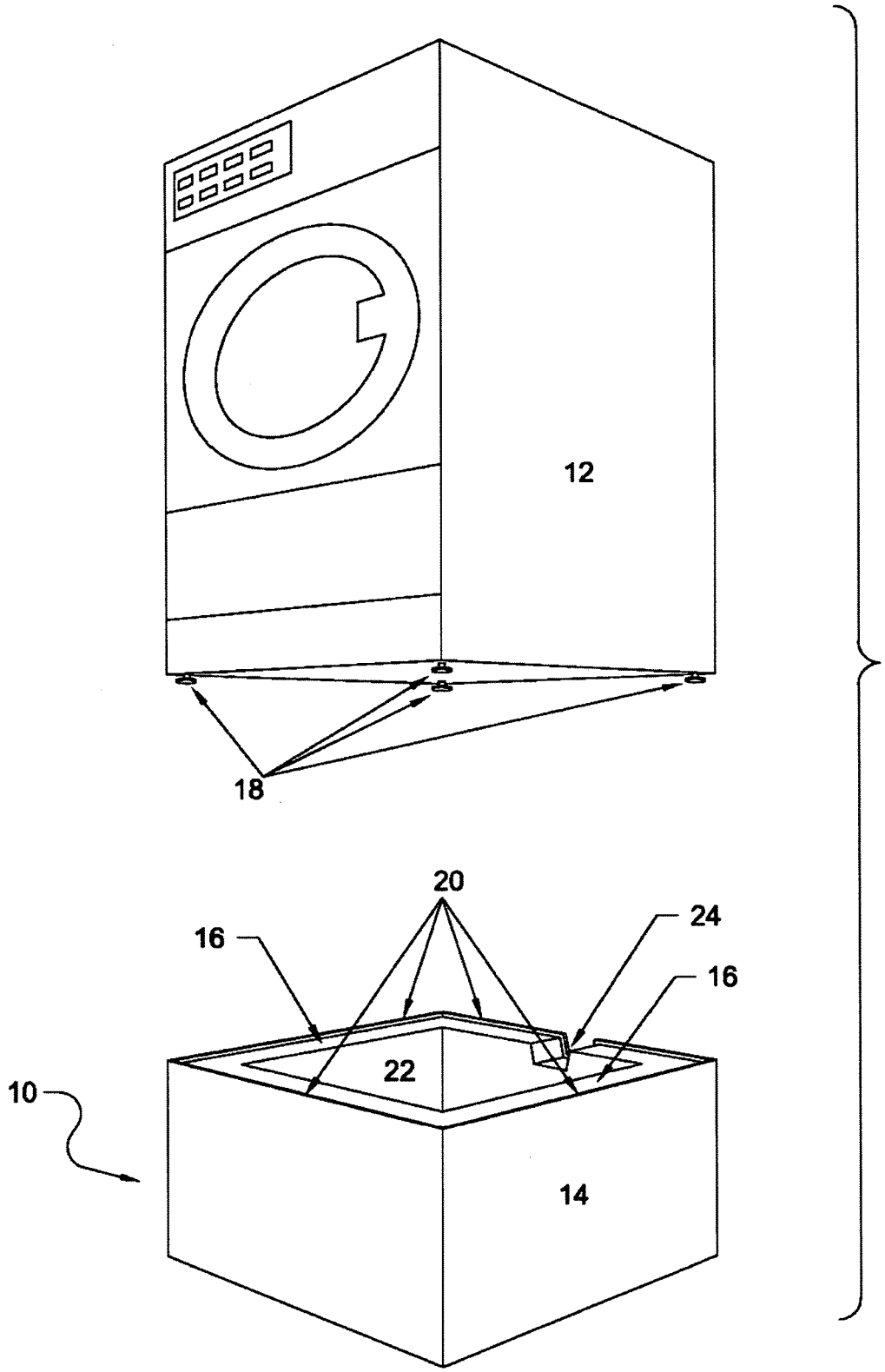
FIG. 1 is an exploded view illustrating the present invention positioned to support an appliance.

Turning first to FIG. 1, there is shown an exploded view illustrating the appliance pedestal 10 of the present inventions in position to support an appliance 12. The appliance 12 is of the type that uses and thus contains a quantity of liquid, typically water, in carrying out its function and may be a clothes washer. As can be seen, the appliance pedestal 10 comprises a housing 14 that is of a three dimensional rectilinear shape and in the illustrated embodiment, the housing 14 is cubical in shape.

The upper surface of the housing 14 is comprised of perimeter rails 16 that support the feet 18 of the appliance 12 supported atop of the housing 14. The uppermost planar surface 16 has a lip 20 to direct liquids leaking from the supported appliance 12 to the interior and to prevent the appliance from slipping off the uppermost planar surface 16. The uppermost planar surface 16 and lip 20 channel liquids to a liquid-tight sump 22 located in the interior of the housing 14. The liquid-tight sump 22 is sized and so positioned so that all liquid leaking from the appliance 12 is directed from the uppermost planar surface 16 and lip 20 to be collected at this single location, however, because the appliance 12 is supported by the upper surface of the uppermost planar surface 16, the liquid that accumulates within the liquid-tight sump 22 remains beneath the appliance 12 and does not create a problem with that liquid contacting the electrical or other functions of the appliance 12. A depression 24 may be provided to allow relief for liquid discharge hoses and external power cords to be later described.

The shape of the housing 14 is not limited to a principally rectilinear form. A different form than that described in the figures, such as a cylindrical form with principally similar sectional features, would function in a similar fashion.

Figure 2:
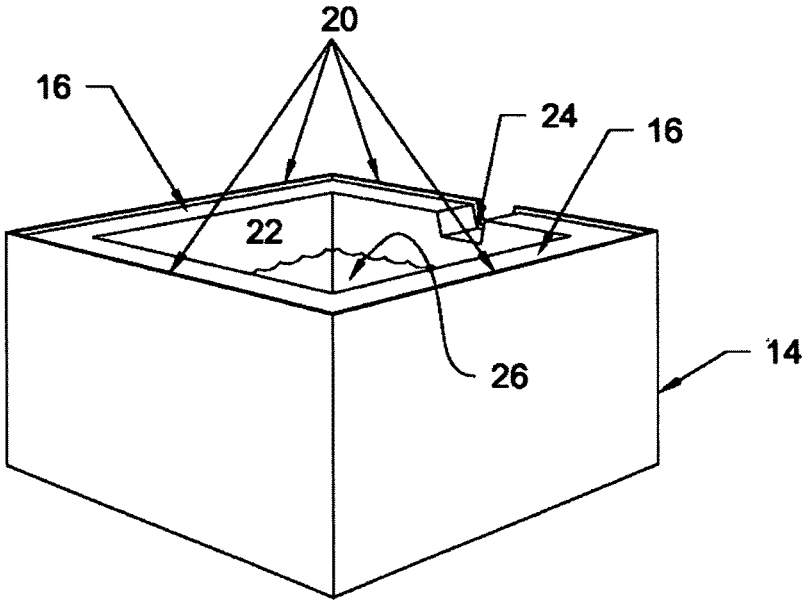
FIG. 2 is a perspective view of appliance pedestal of the present invention.

Turning next to FIG. 2, there is shown a perspective view of the housing 14 of the present invention and, as can be seen, the liquid-tight sump 22 contains a quantity of a liquid 26 and the liquid-tight sump 22 holds that liquid therein. Again, there can be seen, the uppermost planar surface 16 of housing 14.

Figure 3:
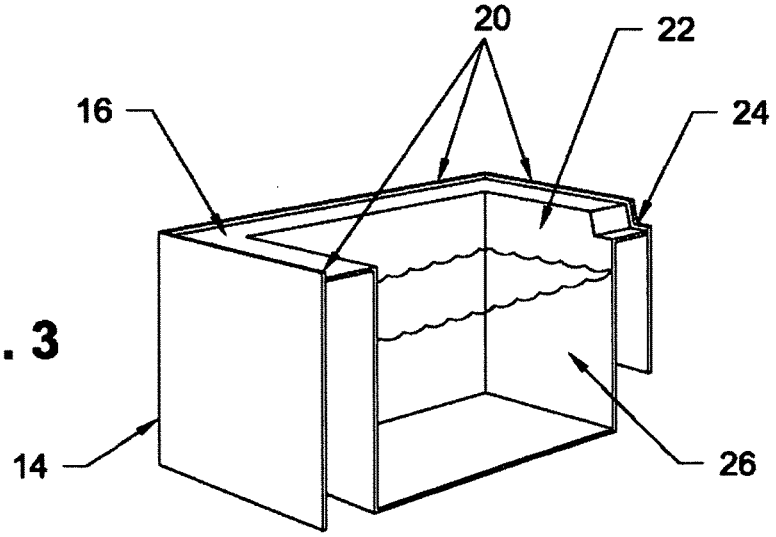
FIG. 3 is a cutaway, perspective view of the appliance pedestal of FIG. 2.

Turning to FIG. 3, there can be seen a cut away perspective view illustrating the level of the liquid 26 contained within the liquid-tight sump 22 and, as can be seen, the level of the liquid 26 stays beneath the uppermost planar surface 16 of the housing 14 where the appliance 12 is supported.

Figure 4:
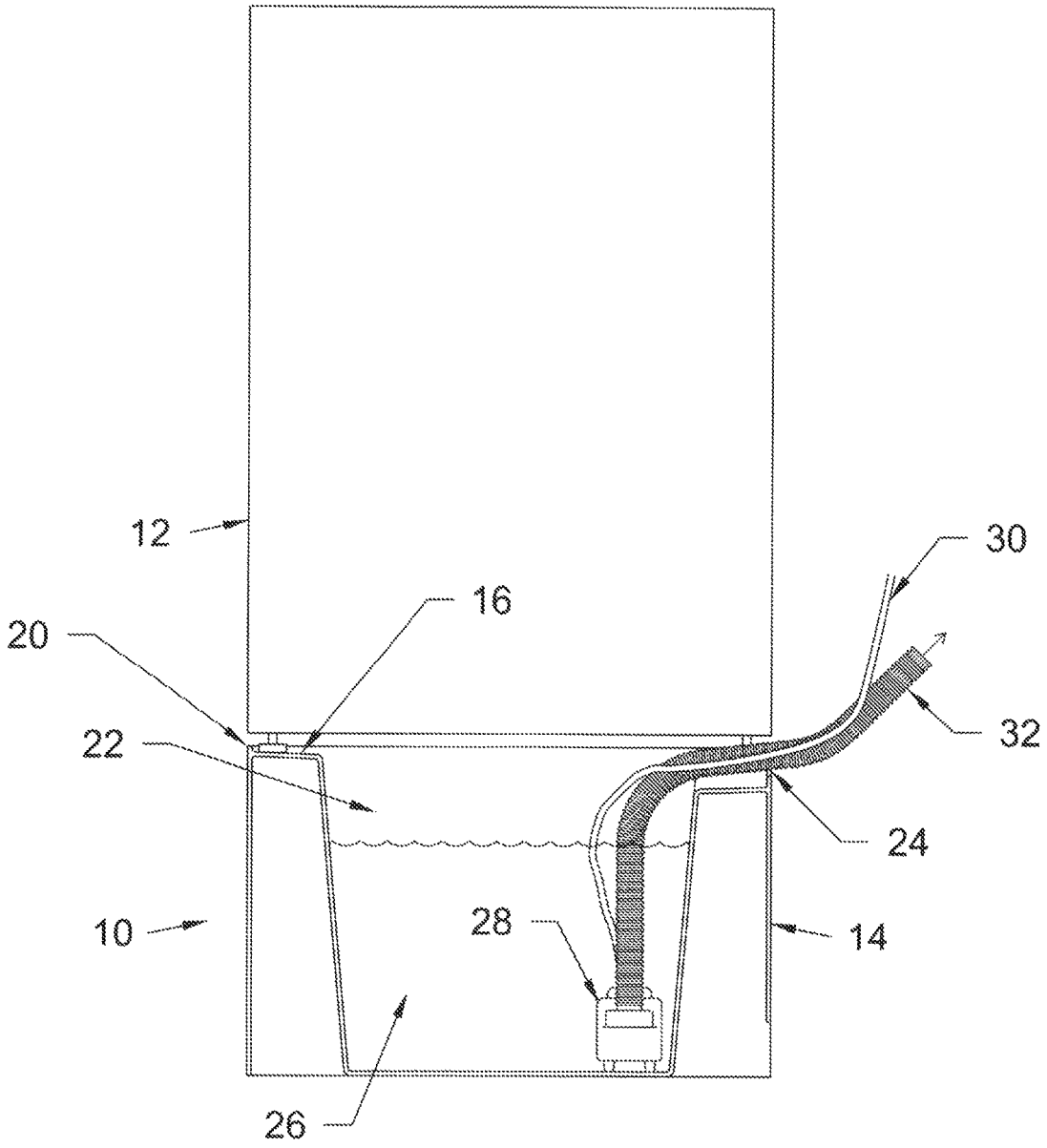
FIG. 4 is a side view, cut away, illustrating an exemplary embodiment of the present invention.

In FIG. 4, there is a side view, cut away, illustrating a discharge system that can be provided to remove liquid from the liquid-tight sump 22. As can be seen, the appliance 12 is resting atop of the uppermost planar surface 16 of the appliance pedestal 10. In this embodiment, there is a submersible pump 28 located beneath the level of the liquid 26 in the liquid-tight sump 22 to discharge that liquid from the liquid-tight sump 22. As can be seen, the electrical cable 30 and liquid discharge hose 32 can pass through the depression 24 and out of the liquid-tight sump 22 to engage an elevated drain or stand pipe.

Figure 5:
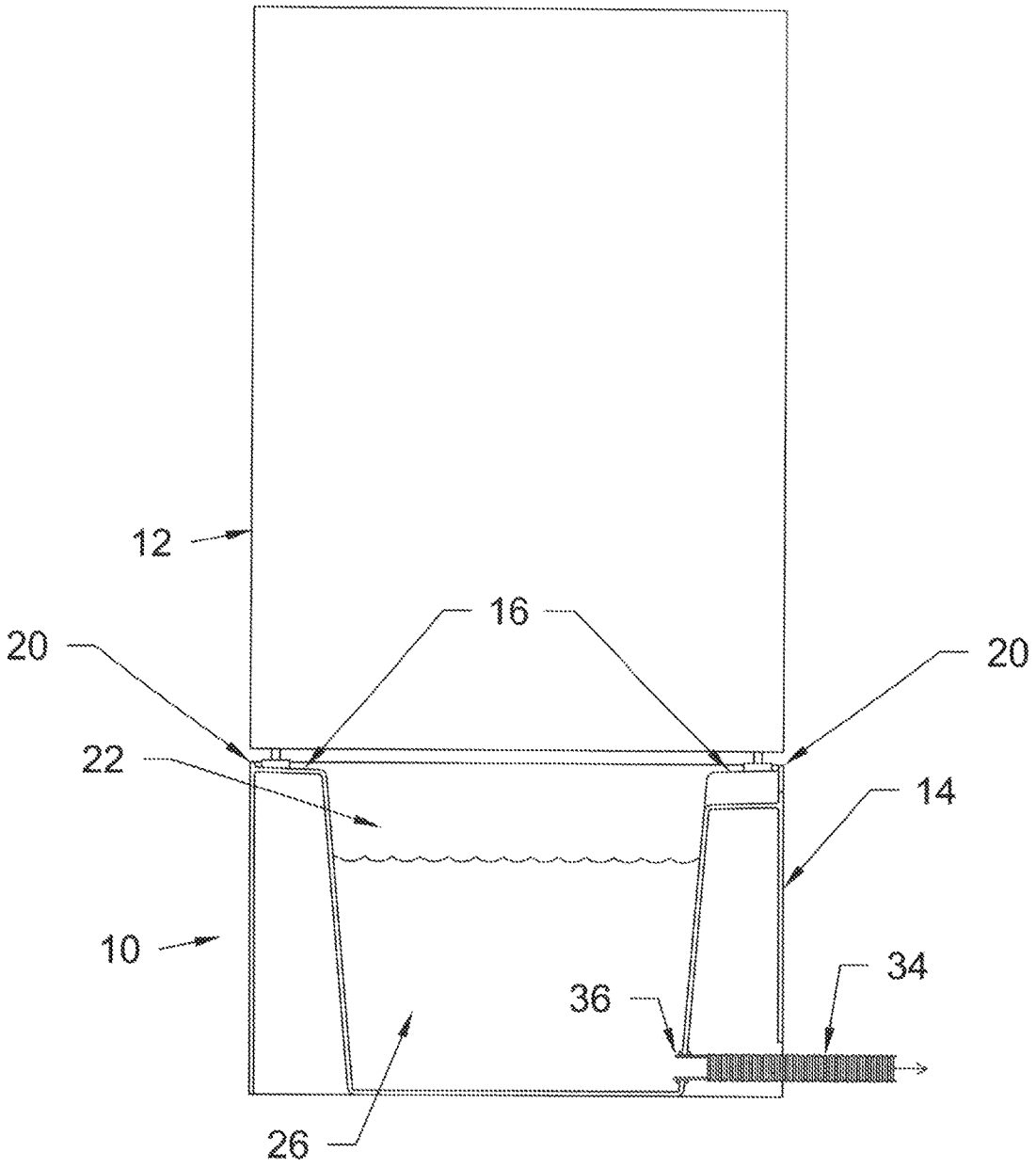
FIG. 5 is a side view, cut away, illustrating a further exemplary embodiment of the present invention.

Turning to FIG. 5, there is a side view, cut away, illustrating a discharge system that is passive, that is, there is a standard ground level drain hose 34 as is customary with current drip and catch pans. The liquid-tight sump 22 can have a tap 36 such that the drain hose 34 will dispose collected liquids 26 to a floor or condensate drain by gravity. Again, as can be seen, the appliance 12 is resting atop of the uppermost planar surface 16 of the appliance pedestal 10.

Figure 6:
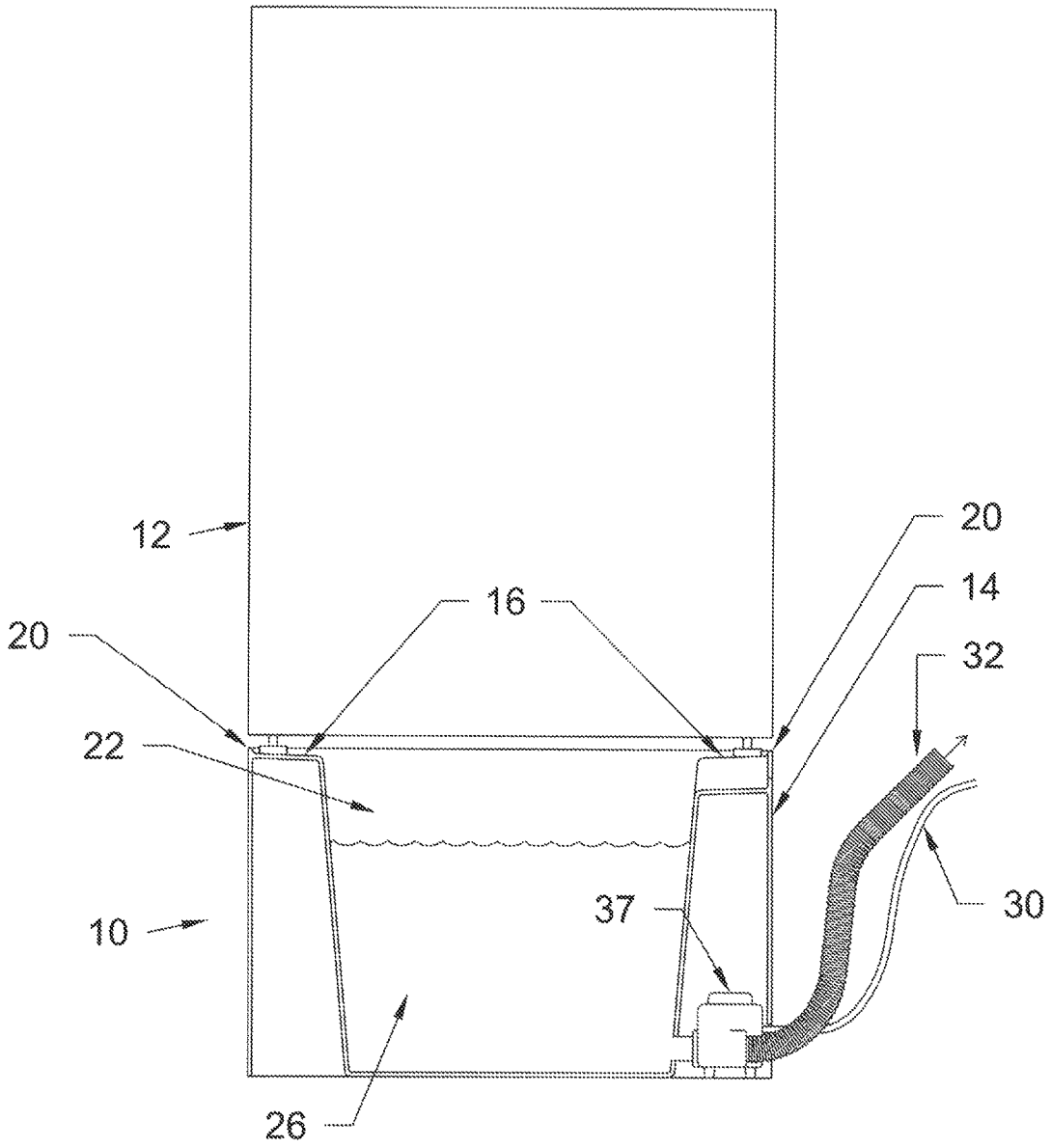
FIG. 6 is a side view, cut away, illustrating a still further exemplary embodiment of the present invention.

In FIG. 6, there is a side view, cut away, illustrating a discharge system wherein a non-submersible pump 37 can be used to discharge the liquid 26 collected in the liquid-tight sump 22 to a drain or drain standpipe. Again, as can be seen, the appliance 12 is resting atop of the uppermost planar surface 16 of the appliance pedestal 10.

Figure 7:
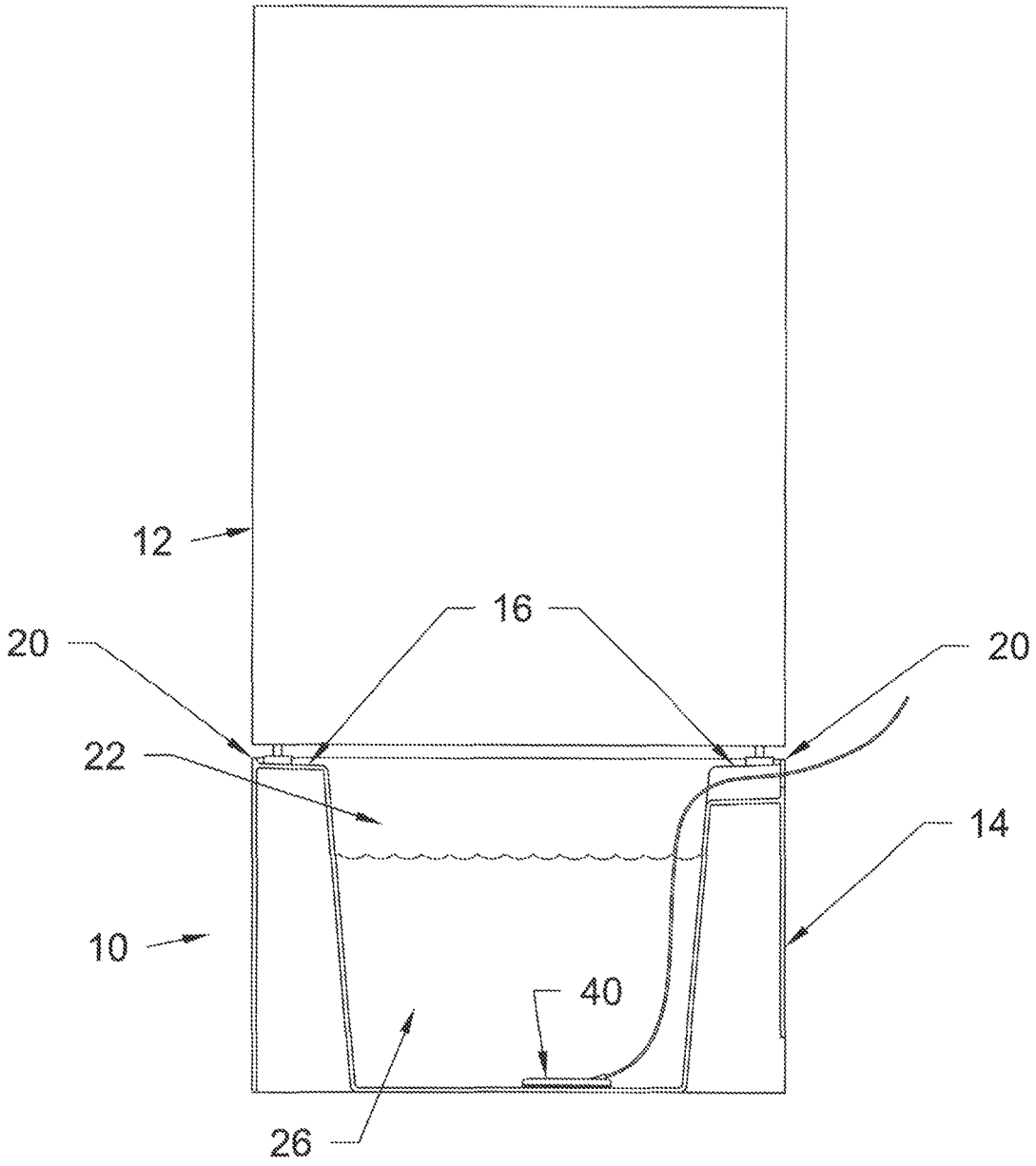
FIG. 7 is a side view, cut away, illustrating a still further exemplary embodiment of the present invention.

In FIG. 7, there is a side view, cut away, illustrating an exemplary embodiment of the present invention wherein a liquid monitor sensor 40 is located in the liquid-tight sump 22 for a more reliable response to a liquid leak. This liquid monitor sensor 40 would be part of an electric/electronic alarm or liquid shut off system used in conjunction with the invention. Again, as can be seen, the appliance 12 resting atop of the uppermost planar surface 16 of the appliance pedestal 10.

Turning to FIGS. 8 and 9, there are shown perspective views of the housing 14 formed in the shape of a drawer 42 or, in the absence of a drawer, an open compartment 44 that can be closed by a drawer 42.

Figure 10:
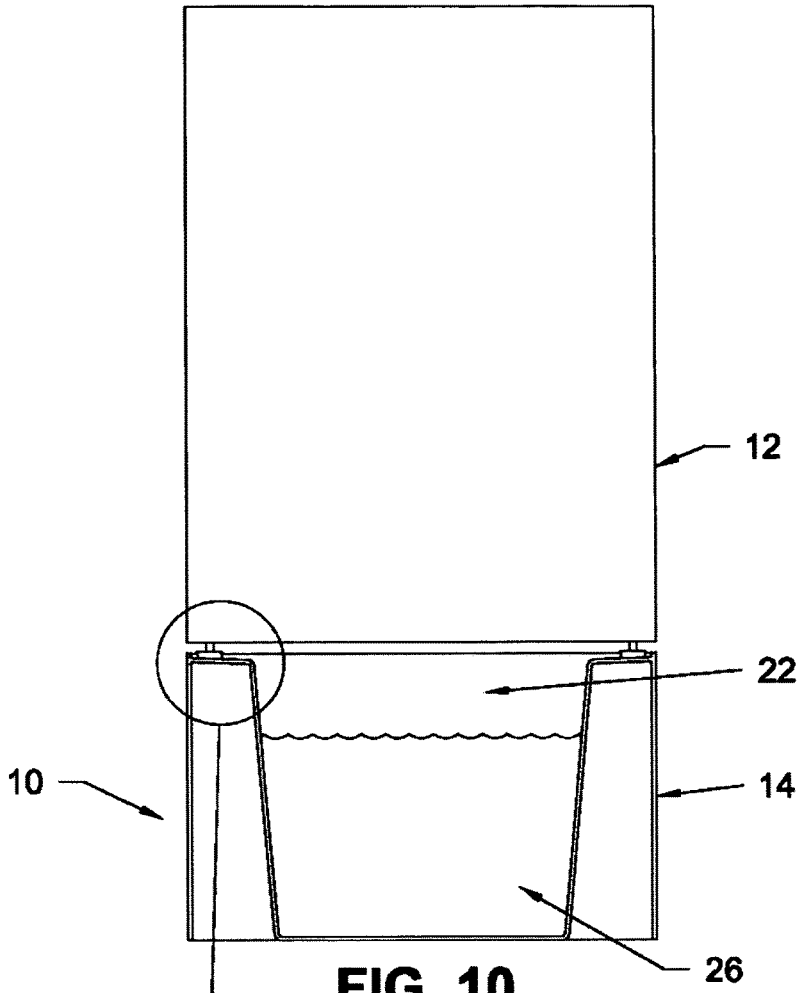
FIG. 10 is a front view, cut away, illustrating the installation of an appliance on the present invention.
Figure 10A:
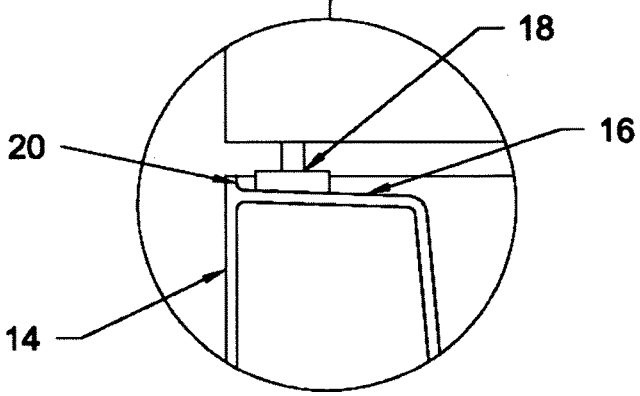
FIG. 10A is an enlarged view of a portion of FIG. 10.

Turning to FIGS. 10 and 10A, there is a front view, cut away, and an enlarged portion view, respectively illustrating the lip 20 that controls the "creep" of the supported appliance 12 to prevent the appliance from coming off of the housing 14 existentially. The creep or shift usually takes place during rapid ground tremors and during "out of balance" conditions that may be present during some appliance operating cycles. The uppermost planar surface 16 has an opposing negative camber of, generally, but not specifically, 3 degrees. This assists the appliance 12 in maintaining a centered position of the appliance 12 on the uppermost planar surface 16 eliminating the need to mount the appliance 12 to the housing 14.

Figures 11, 11A, 11B:
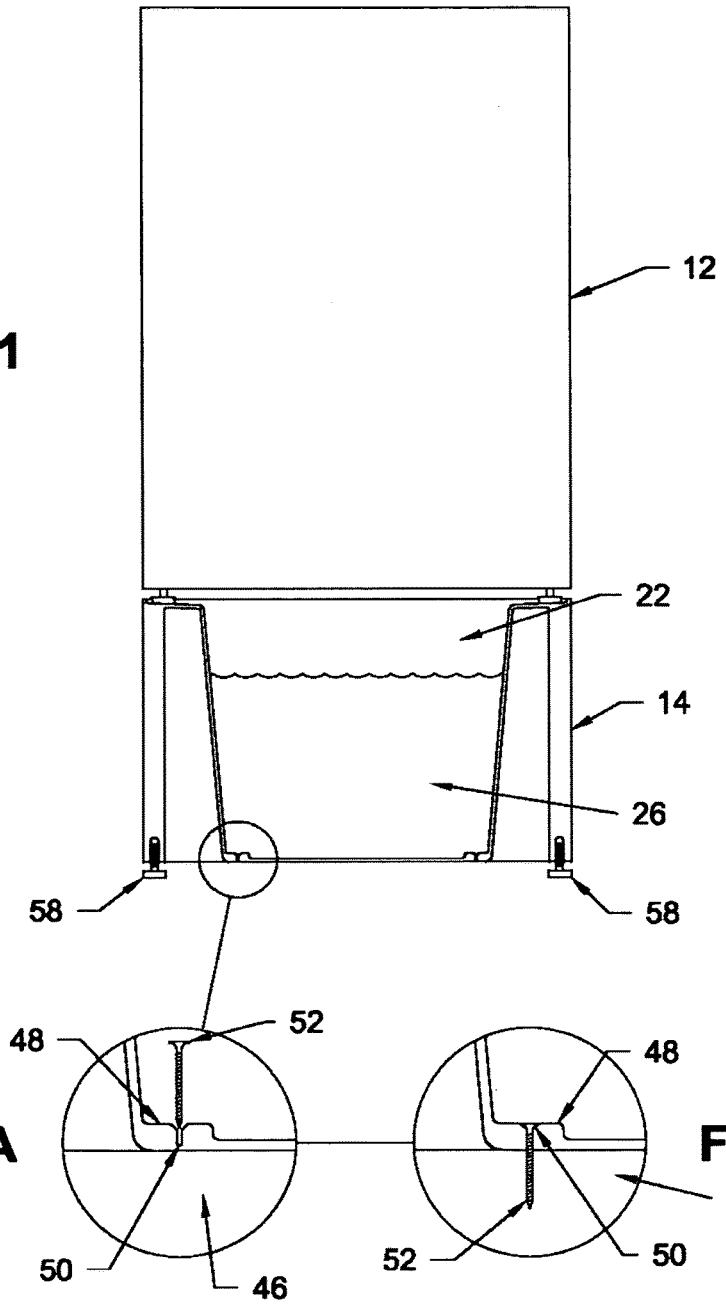
FIG. 11 is a front view, cut away, illustrating the affixation of the appliance pedestal of the present invention to a supporting structure, such as a floor.
FIGS. 11A and 11B are enlarged views of portion of FIG. 11.

Next, taking FIGS. 11, 11A and 11B, there is a front view, cut away and enlarged views illustrating the mounting or anchoring of the housing 14 to a supporting structure 46 such as a floor. Strengthened screw bosses 48 are located in the bottom of the liquid-tight sump 22. Predrilled holes 50 do not extend all the way through the bosses 48 in order to maintain a liquid-tight condition in the event that they are not used. Thread cutting screws 52 pierce through the bottom of the holes 50 and into the support surface 46. When fully installed, the head of the screw 52 seals itself at the top of the boss 48 and at the upper portion of the hole 50, maintaining a liquid-tight condition after mounting. The invention can accept optional leveling legs 54 of the appliance 12 for extremely unleveled or rough support surfaces.

Turning next to FIGS. 12 and 13, there is a side view and a bottom view, respectively, of an exemplary embodiment of the present invention wherein there is an integral air cushion transport system used to facilitate movement of the appliance 12 during installation and maintenance. With this system the appliance pedestal 10 is capable of floating itself and the supported appliance 12 on a cushion of compressed air or gas. A flexible perforated membrane 56 is sealed to the bottom perimeter edges of the housing 14, sealing the internal cavities, external to and below the liquid-tight sump 22. A pattern of vent holes 58 in the membrane 56 make up the only exit from the sealed cavities within the membrane 56. A blower 60 or other source of pressurized gas connected through an external port 62 pressurizes the internal cavities. The pressurized air or gas vents through the vent holes 58 of the membrane 56 lifting the housing 14 as well as the appliance 12 sufficiently to break the friction between the housing 14 and the support surface 46 making the housing 14 and the appliance 12 combination easily moved. The blower 60 could also be integral to the housing 14.

While shown as a full membrane 56, there may also be a skirt located at the perimeter of housing that would serve the same purpose of elevating the housing 14 and appliance 12 when desired.

The invention can be fabricated, molded, cast, pressure formed, or machined of structural materials depending on desired material properties or manufacturing processes available. This invention incorporates functions of liquid leak control into an elevating pedestal.

The present invention supports liquid leak control in both a passive and active manners. For passive control, the present invention provides three methods of improved control. The first is a much higher volume of liquid retention that that of present art. The invention will retain the collected liquids without causing additional degradation of the appliance or the electrical hazards caused by liquid immersion. The second passive control improvement is by directing leaking liquids directly to a liquid sensing device.

By providing an improved location for a water sensing device instead of the typical floor location under or in close proximity to the equipment being monitored, assures that leaking liquids will be directed towards the sensor regardless of the location of the leak within the appliance. This is important due to the fact that slope and location can affect the ability of a liquid sensor to come in contact with the leaking liquid. The third method for passive control is supporting gravity discharge of collected liquids to a floor level drain. The invention also provides active control by forcefully discharging leaking liquids by means of an automatic pump to an elevated drain, standpipe, or remote location.

Figure 14A:
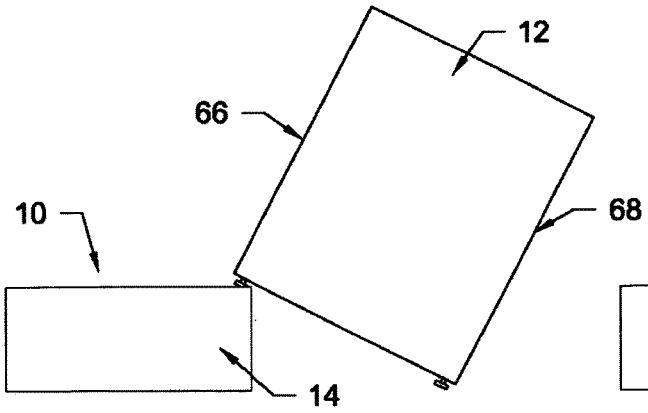
FIGS. 14A-14D are schematic views illustrating the method of loading an appliance on to the present invention.
Figure 14B:
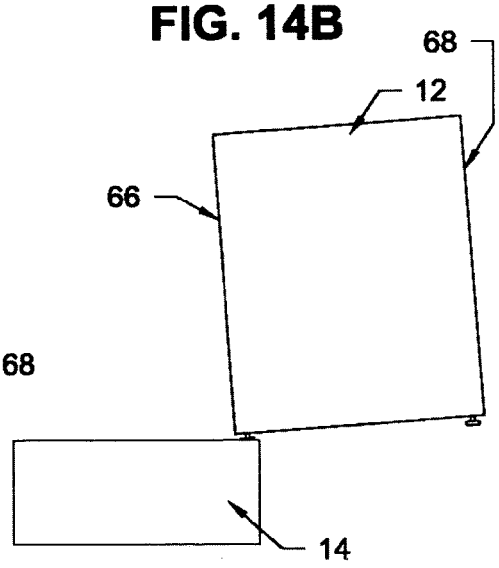
Figure 14C:
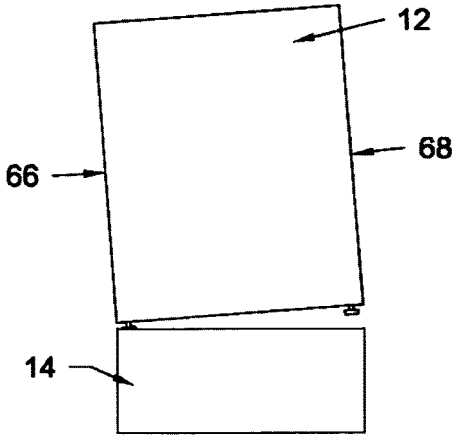
Figure 14D:
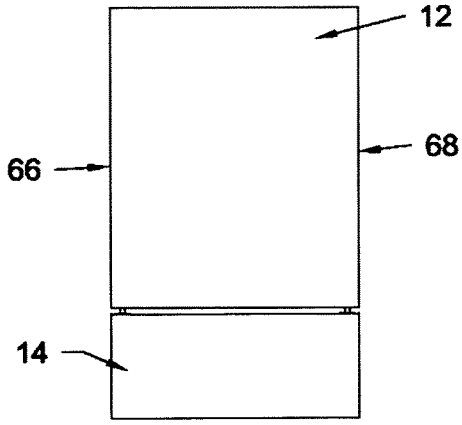

Turning finally to FIGS. 14A-14D, there are shown schematic views illustrating a method of installing and/or removing an appliance 12 to and from an appliance pedestal 10. As will be used to describe the method, the appliance has a rearward side 66 that will be the side toward which the appliance 12 moves in installing it onto the housing 14 and a forward side 68 that is opposite thereto. Accordingly, as shown in FIG. 14A, in installing the appliance 12 onto the housing 14, the appliance 12 is initially tipped forwardly so as to elevate the rearward side 66 to rest it atop of the housing 14. The forward side 68 is then elevated to just above the height of the housing 14 as shown in FIG. 14B, that is, by a rearward tipping motion, and slid on its rearward side 66 into the position shown in FIG. 14C. At the position of FIG. 14C, the forward side 68 is then lowered to a generally horizontal orientation to rest on the housing 14 such that the appliance 12 can be readily installed atop of the housing 14 easily and with a minimum of manipulations in close quarters.

While the present invention has been set forth in terms of a specific embodiment or embodiments, it will be understood that the appliance pedestal herein disclosed may be modified or altered by those skilled in the art to other configurations. Accordingly, the invention is to be broadly construed and limited only by the scope and spirit of the claims appended hereto.

The invention claimed is:

1. An elevating appliance pedestal for receiving liquid leaking from an appliance, the appliance pedestal comprising: a housing forming a liquid-tight sump, said housing having an uppermost planar surface adapted to support an appliance containing a liquid, the uppermost planar surface substantially surrounding an appliance resting atop of the upper most planar surface, wherein the upper most planar surface includes an outer edge and an inner edge, the outer edge comprising a lip extending vertically upwardly along the outer edge of the uppermost planar surface substantially surrounding the upper most planar surface and substantially surrounding an appliance supported on the uppermost planar surface thereon to retain an appliance on the uppermost planar surface, wherein the uppermost planar surface and the lip diverts liquid leaking from the appliance to the liquid-tight sump, the liquid-tight sump located underneath the uppermost planar surface to receive liquid leaking from an appliance, a discharge system for removing liquid from the liquid-tight sump, wherein the uppermost planar surface has a depression and the pump has a discharge hose that passes through the depression.

2. An elevating appliance pedestal for receiving liquid leaking from an appliance, the appliance pedestal comprising: a housing forming a liquid-tight sump, said housing having an uppermost planar surface adapted to support an appliance containing a liquid, the uppermost planar surface substantially surrounding an appliance resting atop of the upper most planar surface, wherein the upper most planar surface includes an outer edge and an inner edge, the outer edge comprising a lip extending vertically upwardly along the outer edge of the uppermost planar surface substantially surrounding the upper most planar surface and substantially surrounding an appliance supported on the uppermost planar surface thereon to retain an appliance on the uppermost planar surface, wherein the uppermost planar surface and the lip diverts liquid leaking from the appliance to the liquid-tight sump, the liquid-tight sump located underneath the uppermost planar surface to receive liquid leaking from an appliance, a discharge system for removing liquid from the liquid-tight sump, wherein the housing includes screw bosses having holes with water-tight, sealing surfaces within the bore of the holes therein adapted to receive thread cutting screws to pierce the water tight, sealing surfaces during installation within the holes to firmly affix the housing to a supporting structure, wherein an underside of the screw heads provide a water tight seal against an upper perimeter of the pierced holes.

* * * * *